US006348440B1

(12) United States Patent
Meskers, Jr. et al.

(10) Patent No.: US 6,348,440 B1
(45) Date of Patent: Feb. 19, 2002

(54) METHOD OF CLEANING A METAL SURFACE

(75) Inventors: Donald A. Meskers, Jr., Levittown; Roger John Arthur Tippett, Newtown, both of PA (US)

(73) Assignee: BetzDearborn Inc., Trevose, PA (US)

( * ) Notice: Subject to any disclaimer, the term of this patent is extended or adjusted under 35 U.S.C. 154(b) by 0 days.

(21) Appl. No.: 09/630,722

(22) Filed: Aug. 2, 2000

(51) Int. Cl.[7] ..... C11D 7/32; C11D 7/34; C11D 7/36

(52) U.S. Cl. ..... 510/253

(58) Field of Search ..... 510/247, 253, 510/254, 255

(56) References Cited

U.S. PATENT DOCUMENTS

| | | | | |
|---|---|---|---|---|
| 3,634,257 A | | 1/1972 | Porter | |
| 3,806,459 A | | 4/1974 | Petrey, Jr. | |
| 3,854,996 A | | 12/1974 | Frost et al. | |
| 3,935,125 A | * | 1/1976 | Jacob | 252/389 A |
| 3,996,062 A | | 12/1976 | Frost et al. | |
| 4,332,967 A | | 6/1982 | Thompson et al. | |
| 4,409,121 A | * | 10/1983 | Latos et al. | 252/389 A |
| 4,495,336 A | | 1/1985 | Hausler et al. | |
| 4,637,899 A | | 1/1987 | Kennedy, Jr. | |
| 4,666,528 A | | 5/1987 | Arrington et al. | |
| 4,670,163 A | | 6/1987 | Lindstrom et al. | |
| 4,719,083 A | | 1/1988 | Baker et al. | |
| 4,810,405 A | | 3/1989 | Waller et al. | |
| 5,078,894 A | | 1/1992 | Horwitz et al. | |
| 5,082,592 A | | 1/1992 | McDonald | |
| 5,230,824 A | | 7/1993 | Carlson, Sr. et al. | |
| 5,264,041 A | | 11/1993 | Kuhnke et al. | |
| 5,587,142 A | | 12/1996 | Horwitz et al. | |
| 5,614,028 A | | 3/1997 | Rodzewich | |
| 5,650,385 A | | 7/1997 | Dunn et al. | |
| 5,736,495 A | | 4/1998 | Bolkan et al. | |
| 5,747,439 A | * | 5/1998 | Dunn et al. | 510/255 |
| 5,834,411 A | * | 11/1998 | Bolkan et al. | 510/245 |

FOREIGN PATENT DOCUMENTS

| | | |
|---|---|---|
| EP | 352120 | 1/1990 |
| GB | 1397451 | 6/1975 |
| WO | 91/17124 | 11/1991 |
| WO | 96/09368 | 3/1996 |
| WO | 98/41606 | 9/1998 |
| WO | 00/46423 | 8/2000 |

OTHER PUBLICATIONS

Database WPI, Section Ch, Week 197612, Derwent Publications Ltd., London GB, Class D25, AN 1976–21482X, XP0021388747, 2/76.

Patent Abstracts of Japan, vol. 010, No. 023 (C–325), Jan. 29, 1986, 60–177190.

English Abstract of DE 4232612, 3/94.

English Abstract of JP 51–013808 A, 2/76.

English Abstract of JP 51–009029 A, 1/76.

English Abstract of JP 09–03670, 1/97.

Chang et al., "Interactions of Metal Hydrous Oxides with Chelating Agents. Part V. Magnetic–EDTA", pp. 90–96, 1982. No month available.

Hausler, "The Importance of the Interphase in the Control of Corrosion in EDTA Solutions", pp. 132–143, 1983. No month available.

Welty, EPRI NP–2815, Cleaning Steam Generators Off–Line (Soaking) with Chelants, 1983, pp.iii to vi, s–1, s–2, 1–2, 1–4, No month available 3–83 to 3–85, 3–104 and 5–1 to 5–3.

March, "Advanced Organic Chemistry", 3rd Edition, pp. 1089–1090, 1985, published by John Wiley & Sons. No month available.

Moniz, Metallurgy, American Technical Publishers, Inc., Homewood, Illinois 60430, 1994, pp. 422–423 No month available.

Shagiev et al., "Investigating the Possibility of Using Oxyethylidenediphoshonic Acid for Removing Deposits", Thermal Engineering, 30 (7), 1983, p. 419–420. No month available.

Glikina et al., "Protection of Boiler Steels Against Corrosion When Removing Dense Iron Oxide Deposits with Hydrochloric Acid Solutions", Teploenergetika, 32, (2), 64–66 (1985): (Thermal Engineering, pp. 106–108). No month available.

Libutti et al., "Rust Cleaning at Moderate pH", TWC–97–37, Ashland, Inc. 1997, pp. 1–17. No month available.

Gray, "In Service Removal of Objectionable Chromate and Corrosion Deposits in Multi–Metal Condenser and Chilled Water Systems", 7th Annual IDHCE Cooling Water Conference, Oct. 1992.

Mundis, "Heat Transfer: Challenges in PWR Steam Generators", CEP Jul. 1983, pp. 39–46.

Nordmann et al., Experimental Investigation on Denting in PWR Steam Generators Causes and Corrective Actions, ASME, 82–JPGC–NE–4, pp. 1–9. No date.

(List continued on next page.)

*Primary Examiner*—John Hardee
(74) *Attorney, Agent, or Firm*—Greenblum & Bernstein, P.L.C.

(57) ABSTRACT

Methods and compositions for controlling corrosion of high strength steels in the presence of a cleaning solution for removing iron oxide scale from metal surfaces. A benzotriazole or benzimidazole compound is added to a combination of ethoxylated mercaptan and/or oxidized ethoxylated mercaptan and 1-hydroxyethylidene-1,1-diphosphonic acid. The composition is added to an aqueous system, such as a steam generating system, to remove scale from the metal surfaces.

36 Claims, No Drawings

OTHER PUBLICATIONS

Beineke et al., "Chemical Neutralization to Control Denting in Nuclear Steam Generators", ASME 82–JPGC–NE–11, pp. 1–9. No date.

Jevec et al., "Effect of Sulfur Bearing Residues form Chemical Cleaning on Alloy 600", Environmental Degradation of Materials in Nuclear Power Systems–Water Reactors, The Metallurgical Society, 1988, pp. 781–788. No month available.

Frenier, "The Mechanics of Magnetite Dissolution in Chelant Solutions", NACE, 1984, pp. 176–180. No month available.

"Chemical Cleaning of Nuclear (PWR) Steam Generators", Welty, Jr. et al., Proceedings of the American Power Conf., vol. 44, 1982. No month available.

Hur et al., Corrosion Behaviors During the Iron Removal Process for Chemical Cleaning of Nuclear Steam Generators,: Journal of Nuclear Materials 224 (1995) 179–186. No month available.

Hausler, "the Role of Hydrazine Containing Chemical Cleaning Solvents", Corrosion/82, Paper No. 30, pp. 30/2–30/16. No date.

* cited by examiner

METHOD OF CLEANING A METAL SURFACE

FIELD OF THE INVENTION

The present invention relates to cleaner compositions and processes useful for removing scale from metal surfaces. The present invention also relates to cleaner compositions and processes that have reduced base metal loss without inhibiting or significantly inhibiting scale removal from metal surfaces. More particularly, the present invention provides for cleaner compositions and processes for removing magnetite containing scale from metal surfaces, especially in steam generating equipment, and especially high strength metals, such as high strength steels, steels used for pressure to vessel plating, welded metals including welded higher strength steels and welded steels used for pressure vessel plating, steels galvanically coupled to stainless steels, and steels containing heat affected zones resulting from a welding process.

BACKGROUND OF THE INVENTION

In steam boilers, feed water heaters, piping and heat exchangers where water is circulated and heat transfer occurs, water insoluble salts deposit on the metallic interior surfaces. The nature of the deposits, such as magnetite ($Fe_3O_4$) deposits, can vary from a tightly adherent low porosity scale to loosely adherent sludge piles.

Excess scale must be removed periodically to ensure proper functioning of the scale suffering system. Previously, scale removing compositions have been employed. Inorganic acids such as hydrochloric and phosphoric acid as well as organic acids have been used to dissolve iron oxide scale. Alkali metal and amine salts of alkylene polyamine polyacetic acids have also been used to remove iron oxide deposits from ferrous metal surfaces.

Steam generators in pressurized water reactor (PWR) nuclear power plants are heat exchangers transferring heat from a primary coolant (pressurized water) system to a secondary coolant system. In the secondary side of PWR nuclear steam generators, magnetite deposits form over time on both the Inconel® Alloy 600 and 690 heat transfer surfaces and the mild steel support structures. This causes problems associated with loss of heat transfer efficiency and corrosion of system metallurgies through denting and pitting mechanisms.

These deposits are removed on an infrequent basis using either off-line chemical or mechanical methods. In general, the mechanical methods are less efficient and more costly than the chemical methods. The industry accepted chemical cleaning method utilizes a 10 to 25% diammonium EDTA cleaning solution at a solution pH of 7.5 or higher. The mild-steel corrosion inhibitor employed is an alkylthiopolyimino-amid with a low sulfur content, which is advantageous in that this lessens the stress corrosion cracking of Inconel® tubes. The cleaning process is typically scheduled to coincide with a refueling outage, and often requires the use of auxiliary heaters to maintain the temperature of the steam generator water at 200° F. to 290° F.

In U.S. application Ser. No. 09/407,173, filed Sep. 28, 1999, and application Ser. No. 09/245,440, filed Feb. 5, 1999, which are incorporated by reference herein in their entireties, cleaner compositions and methods are disclosed that avoid difficulties inherent in earlier processes. In these applications, compositions are disclosed that will remove iron-containing deposits at lower temperatures than EDTA-based cleaners. These cleaner compositions are disclosed to be less aggressive to the base metal being cleaned and will work at a neutral pH. Additionally, the cleaner compositions that are disclosed do not require halogen ions and have a lower sulfur content, as well as being of lower toxicity and easier to handle. In particular, these applications disclose methods for cleaning iron oxide containing scale from a metal surface, comprising contacting the metal surface with an aqueous composition containing 1-hydroxyethylidene-1,1-diphosphonic acid and at least one of ethoxylated mercaptan and oxidized ethoxylated mercaptan.

There is still a need to provide further improvements in metal oxide dissolution while providing high corrosion inhibition in various environments.

SUMMARY OF THE INVENTION

The present invention is directed to a method for cleaning iron oxide containing scale from a surface of at least one of high strength steels, steels used for pressure vessel plating, welded metals, steels galvanically coupled to stainless steels, and steels containing heat affected zones (HAZ) resulting from a welding process, comprising contacting the surface with a composition comprising 1-hydroxy-ethylidene-1,1-diphosphonic acid; at least one of ethoxylated mercaptan and oxidized ethoxylated mercaptan; and at least one third component which in combination with the 1-hydroxy-ethylidene-1,1-diphosphonic acid and at least one of ethoxylated mercaptan and oxidized ethoxylated mercaptan provides a percent corrosion inhibition of greater than about 75% as compared to a composition containing the 1-hydroxy-ethylidene-1,1-diphosphonic acid and the at least one of ethoxylated mercaptan and oxidized ethoxylated mercaptan in the absence of the at least one third component, and a percent oxide dissolution using 80 micron particle sized magnetite of at least about 30% when the solution is maintained at 110° F. at pH 6.5 with no agitation and measured at 72 hours.

Moreover, the present invention is directed to a method for cleaning iron oxide containing scale from a surface of at least one of high strength steels, steels used for pressure vessel plating, welded metals, steels galvanically coupled to stainless steels, and steels containing heat affected zones (HAZ) resulting from a welding process, comprising contacting the surface with a composition comprising 1-hydroxy-ethylidene-1,1-diphosphonic acid and at least one of ethoxylated mercaptan and oxidized ethoxytated mercaptan, and at least one of benzotriazole and benzimidazole compound having the following structure:

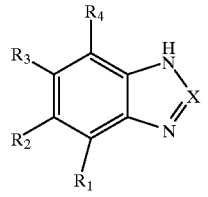

wherein X is C or N, each of $R_1$, $R_2$, $R_3$ and $R_4$ is hydrogen, halogen, or a hydrocarbyl group.

The surface can comprise a steel having a carbon content higher than 0.15 wt %, higher than 0.2 wt %, or higher than 0.3 wt %.

The surface comprise can comprise a steel having a Mn content of higher than 0.9 wt %.

The surface can comprise a steel containing up to 0.25 wt % C, 1.15–1.50 wt % Mn, 0.035 wt % P, 0.04 wt % S, 0.21 wt % Si, 0.45–0.60 wt % Mo, and balance Fe. The steel can further contain 0.40–0.60 wt % Ni.

The surface can comprise a steel containing 0.31–0.38 wt % C, 0.60–0.90 wt % Mn, up to 0.04 wt % P, up to 0.05 wt % S, balance Fe.

The surface can comprise a steel containing up to 0.35 wt % C, up to 0.90 wt % Mn, 0.35 wt % P, up to 0.04 wt % S, 0.15–0.30 wt % Si, balance Fe.

The surface can comprise a steel containing at least one of molybdenum, chromium and nickel.

The percent corrosion inhibition can comprise a percent corrosion inhibition of greater than about 80%, more preferably greater than about 85%, and even more preferably greater than about 90%.

The percent oxide dissolution using 80 micron particle sized magnetite, when the solution is maintained at 110° F. at pH 6.5 with no agitation and measured at 72 hours, can comprise a percent oxide dissolution of at least about 40%, more preferably at least about 45%, and even more preferably at least about 50%.

The percent corrosion inhibition can comprise a percent corrosion inhibition of greater than about 90%, and the percent oxide dissolution using 80 micron particle sized magnetite, when the solution is maintained at 110° F. at pH 6.5 with no agitation and measured at 72 hours, can comprise a percent oxide dissolution of at least about 35%.

Each of $R_1$, $R_2$, $R_3$ and $R_4$ can comprise hydrogen or an alkyl or substituted alkyl, the alkyl or substituted alkyl can contain $C_1$ to $C_8$, more preferably the alkyl or substituted alkyl contains $C_1$ to $C_6$, and even more preferably the alkyl or substituted alkyl contains $C_1$ to $C_4$. The alkyl or substituted alkyl can be branched or straight chained. Three of the $R_1$, $R_2$, $R_3$ and $R_4$ groups can comprise hydrogen, with the fourth $R_1$, $R_2$, $R_3$ and $R_4$ group comprising an alkyl or substituted alkyl group preferably containing $C_1$ to $C_4$.

The benzotriazole compound can comprise butylbenzotriazole and/or tolyltriazole, and the benzimidazole compound can comprise 5-methyl benzimidazole.

The ethoxylated mercaptan can have the formula:

$$H—(—O—CH_2—CH_2—)_n—S—R_1$$

wherein $R_1$ is a hydrocarbyl group, n is 1 to 100, and the oxidized ethoxylated mercaptan comprises oxidized derivatives thereof.

DETAILED DESCRIPTION OF THE INVENTION

Unless otherwise stated, all percentages, parts, ratios, etc., are by weight.

Unless otherwise stated, a reference to a compound or component includes the compound or component by itself, as well as in combination with other compounds or components, such as mixtures of compounds.

Further, when an amount, concentration, or other value or parameter, is given as a list of upper preferable values and lower preferable values, this is to be understood as specifically disclosing all ranges formed from any pair of an upper preferred value and a lower preferred value, regardless whether ranges are separately disclosed.

The present invention relates to methods and compositions for cleaning iron oxide containing deposits from surfaces of at least one of high strength steels; steels used for pressure vessel plating; welded metals including welded high strength steels and welded steels used for pressure vessel plating; steels, including mild steel and high strength steels, galvanically coupled to stainless steels; and steels containing heat affected zones (HAZ) resulting from a welding process, comprising contacting the surfaces with a composition comprising 1-hydroxy-ethylidene-1,1-diphosphonic acid (HEDP) and ethoxylated mercaptan(s) and/or oxidized ethoxylated mercaptan(s), and a third component which in combination with the 1-hydroxy-ethylidene-1,1-diphosphonic acid (HEDP) and ethoxylated mercaptan(s) and/or oxidized ethoxylated mercaptan(s) provides a percent corrosion inhibition of greater than about 75% , more preferably greater than about 80%, even more preferably greater than about 85%, and most preferably greater than about 90%, and a percent oxide dissolution, using 80 micron particle sized magnetite, of at least about 30%, more preferably at least about 40%, even more preferably at least about 45%, and most preferably at least about 50%, when the surfaces are maintained at 110° F. at pH 6.5 with no agitation and measured at 72 hours.

It is noted that the determination of percent corrosion inhibition is with respect to a composition containing the same components but in the absence of the third component. Thus, the comparison is made by comparing the corrosion caused by a composition containing 1-hydroxy-ethylidene-1,1-diphosphonic acid (HEDP) and ethoxylated mercaptan (s) and/or oxidized ethoxylated mercaptan(s) in the absence of the third component to the corrosion caused under the same corrosion conditions caused by a composition containing the same concentration of 1-hydroxy-ethylidene-1,1-diphosphonic acid (HEDP) and ethoxylated mercaptan(s) and/or oxidized ethoxylated mercaptan(s) in the presence of the third component.

The present invention also relates to methods and compositions for cleaning iron oxide containing deposits from metal surfaces, especially steels used for pressure vessel plating and higher strength steels which are generally, but not exclusively carbon steels containing more than 0.15 wt %, even as high as more than about 0.2 wt % carbon, and even as high as more than about 0.3 wt % carbon, steels containing more than 0.90 wt % Mn, or steels containing molybdenum, chromium, or nickel as an alloying element, welded metals including welded high strength steels, steels containing heat affected zones (HAZ) resulting from a welding process, and steels, including mild steels and high strength steels galvanically coupled to stainless steels comprising contacting the surfaces with a composition comprising 1-hydroxy-ethylidene-1,1-diphosphonic acid (HEDP) and ethoxylated mercaptan(s) and/or oxidized ethoxylated mercaptan(s), and at least one of benzotriazole and benzimidazole compound(s).

The ethoxylated mercaptan and/or oxidized ethoxylated mercaptan can comprise various ethoxylated mercaptans and/or oxidized ethoxylated mercaptans including those disclosed in application Ser. No. 09/407,173, filed Sep. 28, 1999, which is incorporated by reference herein in its entirety. Thus, the ethoxylated mercaptan preferably has the formula:

$$H—(—O—CH_2—CH_2—)_n—S—R_1$$

wherein $R_1$ comprises a hydrocarbyl group, and n is 1 to 100, more preferably n is 4 to 20, and even more preferably n is 4 to 12.

As used herein, the term "hydrocarbyl" is understood to include "aliphatic," "cycloaliphatic," and "aromatic." The hydrocarbyl groups are understood to include alkyl, alkenyl, alkynyl, cycloalkyl, aryl, arylalkyl, and alkaryl groups. Further, "hydrocarbyl" is understood to include branched and unbranched compounds, and both non-substituted hydrocarbyl groups, and substituted hydrocarbyl groups, with the latter referring to the hydrocarbon portion bearing additional substituents, besides carbon and hydrogen.

The number of carbon atoms in $R_1$ can vary. Without wishing to be bound by theory, $R_1$ should have a sufficient number of C atoms to provide activity in the aqueous system to provide corrosion inhibition without significantly inhibiting scale removal. Moreover, the number of C atoms is preferably maintained at an upper limit taking at least into consideration compound expense and/or the ability of the compound to be maintained in a useful state in the aqueous system, such as ensuring sufficient solubility of the compound in the aqueous system. Preferably, the hydrocarbyl group contains less than 30 carbon atoms.

Preferably, $R_1$ is an alkyl or substituted alkyl, preferably containing $C_1$ to $C_{30}$, more preferably $C_6$ to $C_{18}$, and even more preferably $C_8$ to $C_{14}$, which can be branched or straight chain, and the substitutions can preferably include hydroxy, sulfonate, phosphate, amino and aromatic groups.

In general, ethoxylated mercaptans can be prepared from a reaction of ethylene oxide and mercaptan of the form $R_1SH$, wherein $R_1$ is defined as above. Examples of $R_1SH$ include, but are not limited to, benzyl mercaptan, cyclohexyl mercaptan, dipentene dimercaptan, ethyl mercaptan, ethylcyclohexyl dimercaptan, ethylthioethanol, isopropyl mercaptan, n-butyl mercaptan, n-decyl mercaptan, n-dodecyl mercaptan, n-hexyl mercaptan, n-octyl mercaptan, n-propyl mercaptan, pinanyl mercaptan-2, s-butyl mercaptan, t-butyl mercaptan, t-dodecyl mercaptan (such as Sulfole®120 available from Phillips Specialty Chemicals, Bartelsville, Okla.), t-mix mercaptan (such as Sulfole®100 available from Phillips Specialty Chemicals, Bartelsville, Okla.), t-nonyl mercaptan (such as Sulfole®90 available from Phillips Specialty Chemicals, Bartelsville, Okla.), 1,2 ethanedithiol, 2-ethylhexyl-3-mercaptopropionate, 2-mercaptoethanol, and 3-mercapto-1-propanol.

Preferably, the ethoxylated mercaptan includes, but is not limited to, ethoxylated alkyl mercaptans, most preferably ethoxylated alkyl mercaptans having about 4 to 12 moles of ethoxylation per mole of mercaptan, including ethoxylated tertiary dodecyl mercaptans, such as those having 6 moles of ethoxylation per mole of mercaptan, e.g., ALCODET 260 available from Shibley Chemicals, Elyria, Ohio, and manufactured by Rhone-Poulenc, those having 8 moles of ethoxylation per mole of mercaptan, e.g., ALCODET SK available from Shibley Chemicals, Elyria, Ohio, and manufactured by Rhone-Poulenc, and those having 10 moles of ethoxylation per mole of mercaptan, e.g., ALCODET 218 available from Shibley Chemicals, Elyria, Ohio, and manufactured by Rhone-Poulenc; and ethoxylated n-dodecylmercaptan, such as those having about 4.9 or about 8.2 moles ethoxylation per mole of mercaptan. Burco TME, which is available from Burlington Chemicals, Burlington, N.C., is a particularly preferred ethoxylated alkyl mercaptan. Ethoxylated 2-phenylethyl mercaptans having about 6.7 moles ethoxylation per mole of mercaptan are also preferred.

Preferably, oxidized ethoxylated mercaptans are utilized in the composition according to the present invention. In particular, it noted that oxidized ethoxylated mercaptans provide exceptional corrosion inhibition without inhibiting scale removal from metal surfaces. Thus, while ethoxylated mercaptans have been found to provide exceptional corrosion inhibition combined with very low levels of metal loss when utilized in conjunction with HEDP, it was further discovered that oxidized ethoxylated mercaptans provide an even greater corrosion inhibition when utilized in conjunction with HEDP.

The ethoxylated mercaptan can be oxidized utilizing various procedures, and one having ordinary skill in the art would be able to oxidize ethoxylated mercaptans following the guidance provided herein. For example, methods such as disclosed in "Advanced Organic Chemistry" by Jerry March, 3rd Edition, pages 1089–1090, 1985, published by John Wiley & Sons, which is incorporated by reference in its entirety.

For example, without limiting the manner of oxidizing the ethoxylated mercaptans, the ethoxylated mercaptans can be oxidized using hydrogen peroxide. Thus, as an example of oxidization of ethoxylated mercaptans according to the present invention, the ethoxylated mercaptans can be reacted with hydrogen peroxide, such as by utilizing an aqueous solution of hydrogen peroxide preferably containing about 1 to 70 wt %, more preferably about 30 to 50 wt %, at a temperature of preferably about 25° C. to 100° C., more preferably about 40° C. to 60° C., for a sufficient period of time to oxidize the ethoxylated mercaptan, preferably about 30 minutes to 8 hours, more preferably about 1 to 2 hours.

Residual hydrogen peroxide can be removed utilizing any method for removing the hydrogen peroxide which is not detrimental or which is substantially non-detrimental to the oxidized ethoxylated mercaptan. For example, residual hydrogen peroxide can be removed by raising the pH of the reaction composition that contains the oxidized ethoxylated mercaptan and the residual hydrogen peroxide, or a catalyst for hydrogen peroxide can be added to reaction composition. Thus, for example, the pH of the reaction composition can be raised to at least about 10 and/or a catalyst, such as at least one of platinum, palladium, ferric chloride, cobalt chloride, and cupric chloride can be added to the reaction composition. While there is no upper limit to the pH, preferably the pH is maintained below about 14, with a preferred range being about 10–12.

Without wishing to be bound by theory, it is believed that the sulfur component of the ethoxylated mercaptan is oxidized in the oxidation reaction to sulfoxide. Moreover, it is believed that at least some of the sulfoxide is further oxidized to sulfone. Thus, it is believed that the oxidized ethoxylated mercaptan contains sulfoxide and/or sulfone groups.

For purposes of the present invention, the term ethoxylated mercaptan can include a mixture of one or more ethoxylated mercaptans, and the term oxidized ethoxylated mercaptan (also alternatively referred to herein as "derivatives of ethoxylated mercaptans") can include mixtures of one or more oxidized ethoxylated mercaptans. Moreover, according to the present invention, there can be mixtures of ethoxylated mercaptans and oxidized ethoxylated mercaptans.

Benzotriazole and benzimidazole compounds according to the present invention can comprise compounds of the following structure:

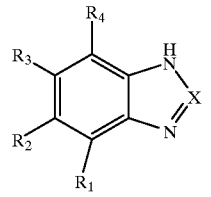

wherein X can be C or N, each of $R_1$, $R_2$, $R_3$ and $R_4$ can comprise hydrogen, halogen, e.g., chlorine, bromine and/or iodine, or a hydrocarbyl group. Preferably, $R_1$, $R_2$, $R_3$ and $R_4$ comprise hydrogen, chlorine or an alkyl or substituted alkyl, preferably containing $C_1$ to $C_8$, more preferably $C_1$ to $C_6$, and even more preferably $C_1$ to $C_4$, which can be branched or straight chain, and the substitutions can preferably include hydroxy, sulfonate, phosphate, amino and aromatic groups. Most preferably, three of the $R_1$, $R_2$, $R_3$ and $R_4$ groups comprise hydrogen, and the fourth $R_1$, $R_2$, $R_3$ and $R_4$ group comprises an alkyl group containing $C_1$ to $C_8$, more preferably $C_1$ to $C_6$, and even more preferably $C_1$ to $C_4$. Still more preferably, $R_1$, $R_3$ and $R_4$ are hydrogen, and $R_2$ comprises from $C_1$ to $C_6$ carbon atoms, more preferably from $C_1$ to $C_4$ atoms. Preferred benzotriazole compounds include benzotriazole, butylbenzotriazole (wherein $R_2$ is a butyl group), and tolyltriazole (wherein $R_2$ is a methyl group). Tolyltriazole is also known by its Chemical Abstract No. as CAS#29385-43-1, and synonyms include tolutriazole, methyl-1H-benzotriazole, 5-methylbenzotriazole, 5-methyl-1,2,3-benzotriazole and cobratec tt-100.

Preferred benzotriazole compounds include:

5-chloro benzotriazole 5,6 dimethyl benzotriazole tolyltriazole (CAS#29385-43-1)

benzotriazole (CAS#95-14-7)

butyl benzotriazole ethyl benzotriazole diethyl benzotriazole

Preferred benzimidazole compounds include:

Benzimidazole [51-17-2] Aldrich Chemical, Milwaukee, Wis.

5-Methyl benzimidazole [614-97-1] Aldrich Chemical, Milwaukee, Wis.

2-Methylbenzimidazole [615-15-6] Aldrich Chemical, Milwaukee, Wis.

The metal can be any metal for which removal of an iron oxide while obtaining corrosion inhibition is desired. In particular, metals treated according to the present invention can include, but are not limited to, mild steel, high-strength low-alloy steel (HSLA), steels used for pressure vessel plating, and high strength steels which are generally, but not exclusively carbon steels containing more than 0.15 wt % carbon, even as high as more than 0.2 wt % carbon, and even has high as more than 0.3 wt % carbon, steels containing more than 0.90 wt % Mn, or steels containing molybdenum, chromium, or nickel as an alloying element. Preferably, metals treated according to the present invention include steels used for pressure vessel plating, high strength steels, welded metals including welded high strength steels, steels containing heat affected zones (HAZ) resulting from a welding process and steels, including mild steel and high strength steel galvanically coupled to stainless steel, such as Inconel® Alloy 600 (UNS N06600) or Inconel® Alloy 690 stainless steel (UNS N06690).

For example, high strength steels and steels used for pressure vessel plating according to the present invention include SA-533 grade A (UNS K12521); SA-533 grade B (UNS K12539); AISI-1035 (UNS G10350); and SA-515 Grade 70 (UNS K03101). SA-533 grade A (UNS K12521) is a high tensile strength, low carbon steel that contains up to 0.25 wt % C, 1.15–1.50 wt % Mn, 0.035 wt % P, 0.04 wt % S, 0.21 wt % Si, 0.45–0.60 wt % Mo, and balance Fe, and is generally used for pressure vessel plating. SA-533 grade B (UNS K12539) and SA-515 Grade 70 (UNS K03101) are similar in nature to SA-533 grade A (UNS K12521). SA-533 grade B contains 0.40–0.60 wt % Ni in addition to the components of SA-533 grade A. AISI-1035 contains 0.31–0.38 wt % C, 0.60–0.90 wt % Mn, up to 0.04 wt % P, up to 0.05 wt % S, balance Fe. SA-515 grade 70 contains up to 0.35 wt % C, up to 0.90 wt % Mn, 0.35 wt % P, up to 0.04 wt % S, 0.15–0.30 wt % Si, balance Fe.

Expanding upon the discussion of welded metals and heat affected zones, reference is made to Metallurgy, by B. J. Moniz, American Technical Publishers, Inc., Homewood, Ill. 60430, 1994, pages 422–423, which is incorporated by reference in its entirety herein. Thus, it is noted that a weld joint includes three distinct metallurgical regions, which are the weld bead (which includes the weld metal), the heat affect zone (which is a narrow region of the base metal adjacent to the weld bead, which is metallurgically altered during the heat of welding), and the base metal (which is the region of metal that is joined by the welding process and is not metallurgically affected by the heat of welding).

The cleaning composition of the present invention is typically added to steam generating systems, beat exchangers and other high pressure vessels where heat transfer to an aqueous medium occurs. These systems often have ferrous metal surfaces where magnetite scaling can occur.

The cleaning composition is preferably employed in the secondary side of Pressurized Water Reactor nuclear steam generators which contain bundles of metal tubes held in place by tube sheets and support plates.

The cleaning composition may be added to systems, such as the above-noted systems, as an active recirculating system, e.g., where the system is undergoing operation to at least partially, and preferably substantially completely or completely achieve usual system performance such as by being on-line. The cleaning composition may also be preferably added off-line, such as adding the cleaning composition to an off-line nuclear steam generator. Off-line addition includes static cleaning wherein the cleaning composition is not moving or substantially non-moving, such as wherein the cleaning composition is added to a container and/or a pipe and not circulated therein. Moreover, off-line addition includes scale removal wherein the cleaning composition is caused to flow, such as by being agitated, such as by bubbling with an inert gas, such as nitrogen, or by being circulated, such as by a pump and/or gravity. When added off-line, the cleaning composition may be left in contact with the metal surface for extended periods of time, such as long as 7 days, even as long as 10 days, or longer. This period of time will vary depending upon the temperature of the water and the extent and amount of magnetite scale on the surfaces contained therein. In particular, the lower the temperature, the longer the contact time required to removal the scale. For example, at temperatures of about 25° C. to 100° C., in a static cleaning system, the cleaning composition can be contacted with the surface to be cleaned for about 3 hours to 10 days.

The cleaning composition may be employed alone or as a precursor to the use of mechanical cleaning methods such as sludge lancing, upper bundle hydraulic cleaning, ultrasonic technology, or any technique that is intended to remove oxide sludge by physical means.

Typically, the cleaning composition is added as an aqueous solution. The individual components of the composition may be added separately or together depending upon the particular system treated. Additionally, the cleaning composition may be added neat to the system to be treated. The total amount of cleaning composition to be added to the system will vary depending upon the amount of magnetite scale and the temperature of the water. The cleaning composition may be added to the system to be treated in an amount ranging from about 0.1 to about 50,000 parts ethoxylated mercaptan per million parts of solution in the system, more preferably about 0.1 to about 20,000 parts ethoxylated mercaptan per million parts of solution in the system, more preferably from about 500 to 10,000 parts ethoxylated mercaptan per million part of solution in the system, even more preferably from about 1,000 to 5,000 parts ethoxylated mercaptan per million parts of solution in the system, with one preferred value being about 2,500 parts ethoxylated mercaptan per million parts of solution in the system. Moreover, the cleaning composition may be added to the system to be treated in an amount ranging from about 1 to 200,000 parts HEDP per million parts of solution in the system, preferably 5,000 to 100,000 parts HEDP per million parts of solution in the system, even more preferably 20,000 to 80,000 parts HEDP per million parts of solution in the system, with one preferred value being about 43,500 parts HEDP per million parts of solution in the system. Still further, the cleaning composition may be added to the system to be treated in an amount ranging from about 0.1 to about 50,000 parts benzotriazole and/or benzimidazole compound per million parts of solution in the system, more preferably about 0.1 to about 20,000 parts benzotriazole and/or benzimidazole compound per million parts of solution in the system, more preferably from about 500 to 10,000 parts benzotriazole and/or benzimidazole compound per million parts of solution in the system, even more preferably from about 1,000 to 5,000 parts benzotriazole and/or benzimidazole compound per million parts of solution in the system, with one preferred value being about 2,500 parts ethoxylated mercaptan per million parts of solution in the system.

The weight ratio of HEDP to at least one of ethoxylated mercaptan and oxidized ethoxylated mercaptan will range from about 4 to 1 to 200 to 1, more preferably from about 4 to 1 to 80 to 1, even more preferably from about 4 to 1 to 50 to 1, with one preferred weight ratio being about 17 to 1.

The weight ratio of HEDP to at least one of benzotriazole and benzimidazole compounds will range from about 4 to 1 to 200 to 1, more preferably from about 4 to 1 to 80 to 1, even more preferably from about 4 to 1 to 50 to 1, with one preferred weight ratio being about 17 to 1.

The inventive cleaning composition may be added to the system to be treated with additional chemicals serving other purposes in the system. This holds true whether the chemical is added with the cleaning solution or is already present in the aqueous system.

These other chemicals typically can be reducing agents such as L-ascorbic acid, hydroquinone, sodium sulfite, diethylhydroxylamine, hydrazine, erythorbic acid or carbohydrazide; anionic polymers such as carboxylates (e.g. polyacrylic acid, polymethacrylic acid and copolymers thereof) poly(alkenyl)phosphonic acids; surfactants such as phosphate esters, polyethylene oxide, polypropylene oxide and copolymers thereof, fatty acid amides and ethoxylated alcohols; hydrotropes such as sodium xylene sulfonate; and corrosion inhibitors in addition to benzotriazoles and tolyltriazole, which are known copper corrosion inhibitors. For purposes of the present invention, this list is merely representative and not meant to be exclusive.

Moreover, it is once again noted, as indicated above, that the compositions and processes of the present invention can include other corrosion inhibitors in addition to the ethoxylated mercaptan and/or oxidized ethoxylated mercaptans and the benzimidazole and benzotriazole compounds of the present invention.

The cleaning composition of the present invention can be employed at pH's at least about 5 or above, more preferably at least about 6 or above, with a preferred range of about 5 to 12, more preferably about 6 to 12, and even more preferably about 6 to 8. The pH of the cleaner composition can be adjusted, preferably to a pH greater than about 5, more preferably to a pH greater than about 6, and more preferably to a pH of about 6 to 8, using various materials that can raise the pH of the system, preferably by using alkali metal hydroxide salts such as NaOH or KOH, organic amines, or ammonia.

Besides the ability to remove magnetite deposits from ferrous metal surfaces, particularly the secondary side of PWR nuclear steam generators, the present inventors anticipate that the cleaning composition will be effective in pre-operational boiler cleaning in fossil fuel systems, off-line and on-line boiler cleaning, cleaning of closed and open loop cooling systems and heat exchangers. Moreover, the present invention can be utilized in any system requiring the removal of magnetite from high strength steels.

The invention will now be described with respect to certain examples which are merely representative of the invention and should not be construed as limiting thereof.

EXAMPLES

The invention is illustrated in the following non-limiting examples, which are provided for the purpose of representation, and are not to be construed as limiting the scope of the invention. All parts and percentages in the examples are by weight unless indicated otherwise.

Acronyms utilized in the examples for ingredient utilized in the examples are defined in Table 1, with one column in Table 1 providing the common name of the ingredient and one column providing how the ingredient was obtained, such as by denoting its source or indicating how the chemical compound was prepared.

Corrosion and iron oxide dissolution studies were performed in a three-neck 250 mL glass flask. This flask is referred to as the process vessel. The vessel surface was prepared by rinsing with several aliquots of acetone followed by deionized water. Magnetite (0.5555 grams, nominal 80 micron size particles, Strem Chemical, Newburyport, Mass.) and deionized water (1 mL) were then introduced to the process vessel forming a slurry.

The test cleaner solutions were prepared separately. The components of the cleaner solution were added to deionized water (100 mL) in a 250 mL Pyrex beaker. The cleaner solution was then titrated to pH indicated in the examples with ammonium hydroxide. The beaker volume was increased to 200 mL with deionized water and the solution was heated to the temperature of usually 110° F., or as indicated, using a waterbath.

When the cleaner reached temperature, the process vessel containing the magnetite was positioned in the waterbath and the cleaning solution was slowly poured into the process vessel, and heated to usually 110° F., or as indicated. The resultant solution contained 2000 ppm magnetite as Fe and the cleaner solution at the desired concentration. A metal coupon, as indicated in the examples, typically with a surface area of approximately 18.704 $cm^2$ was placed horizontally into the vessel such that it was fully immersed in the cleaning solution.

Prior to use, the metal coupons were sonicated in acetone for ten minutes at room temperature. The coupon surface was prepared with a pumice buff followed by thorough deionized water rinses and drying with compressed nitrogen. The initial coupon weights were recorded. After the coupon was added to the process vessel, the thermometer, air lock and sealed glass adapter were inserted into the process vessel. The date and initial conditions (time, pH, and temperature) were recorded. The solution was then maintained at temperature for the prescribed cleaning time.

After the cleaning time, the temperature, dried filter weight, and time were recorded. The coupon was removed from the process vessel with loose oxides gently rinsed back in the process vessel. The coupon surface was immersed into an inhibited acid for 10 minutes and then rinsed and dried with a nitrogen stream. A final coupon weight was then taken. Dissolution performance was determined by filtration of the hot processed cleaner solution through a dried and pre-weighed 0.2 $\mu$m filter using a vacuum pump set to 10 psig. The used filter paper was dried and re-weighed . A sample of the filtrate of the cleaner solution was taken for iron analysis by Inductively Coupled Plasma Atomic Emission Spectroscopy (ICP) and for determination of the final solution pH.

Cleaner performance was evaluated using the coupon and filter weights in the equations below. Note that all weights are expressed in grams Dissolution (%)

((initial oxide weight−final oxide weight)/initial oxide weight)×100

Metal Loss (microns)

(((initial coupon weight−final coupon weight)/coupon density)/coupon area)×10000

Corrosion Inhibition (%)

((metal loss[Burco TME only]−metal loss [with second inhibitor])/metal loss [Burco TME only])×100

Table 1 describes the materials utilized in the examples.

TABLE 1

| Material | Description |
|---|---|
| Burco TME | Ethoxylated tertiary alkyl mercaptan having approximately 8 moles ethoxylation per mole of mercaptan, available from Burlington Chemicals, Burlington, N. C. |
| ALCODET SK | Ethoxylated branched dodecyl mercaptan having 8 moles of ethoxylation per mole of mercaptan, available from Shibley Chemicals*, Elyria, OH |
| Tartaric Acid | Aldrich Chemical, Milwaukee, WI |
| Butyl-benzotriazole | PMC Specialties, Cincinnati, OH |
| Tolyltriazole (TTA) | PMC Specialties, Cincinnati, OH |
| CCI-801 | Alkylthiopolyamino-amid, available from Petrolite, St. Louis, MO |
| Belcor 590 | Polycarboxylic Acid, FMC Corp. |
| Dibutylthiourea | Dibutylthiourea, available from Aldrich, Milwaukee, WI |
| Inhibitor R | Phosphoric acid/diethylthiourea |
| Bricorr 288 | 40 wt % sodium salt solution of a phosphono- carboxylic acid mixture, Albright & Wilson Americas Inc., Glen Allen, VA |
| Polyrad 1110 | Ethoxylated (11 mole) technical hydroabietylamine, Hercules Incorporated, Wilmington DE |
| Citric Acid | Aldrich Chemical, Milwaukee, WI |
| Gluconic Acid | Aldrich Chemical, Milwaukee, WI |
| Polyrad 515 | Ethoxylated (5 mole) technical hydroabietylamine, Hercules Incorporated, Wilmington DE |
| 2-Phenyl-w-Imidazoline | Sigma Chemical, St. Louis, MO |
| Glucoheptonic Acid | Aldrich Chemical, Milwaukee, WI |
| $NaNO_2$ | Aldrich Chemical, Milwaukee, WI |
| Cationic Surfactant | Hercules Incorporated, Wilmington DE |
| CMC | Carboxymethylcellulose, Sigma Chemical, St. Louis, MO |
| Catechol | Aldrich Chemical, Milwaukee, WI |
| Polyrad 515A | Ethoxylated (5 mole) technical hydroabietylamine isopropanol, Wilmington DE |
| Polyrad 1110A | Ethoxylated (10 mole) technical hydroabietylamine in isopropanol, Wilmington DE |
| 5 methyl benzimidazole | Aldrich Chemical, Milwaukee, WI |
| Pectin | Aldrich Chemical, Milwaukee, WI |
| Hexamethylene Tetraamine | Johnson Matthey, Ward Hill, MA |

*Manufactured by Rhone-Poulenc

Examples 1–4 and Comparative Examples C1–C26

In these examples, the procedure as noted above was utilized to test ASTM 533 Grade A coupons, obtained from Metal Samples, Munford, Ala. 4.35 wt % HEDP was tested in the presence of Burco TME as a primary corrosion inhibitor at a 0.25 wt % concentration (unless otherwise indicated), with or without the presence of secondary corrosion inhibitor at 110° F., at pH 6.5 for 72 hours, with 80 micron particle sized magnetite being equal to 2000 ppm Fe.

Table 2 illustrates the results of these tests, as follows:

TABLE 2

| Example | Primary Inhibitor Burco TME (wt %) | Secondary Inhibitor (0.25 wt % when present) | Corrosion Inhibition % | % Oxide Dissolution |
|---|---|---|---|---|
| 1 | 0.25 | Butyl-benzotriazole | 92.6 | 38.17 |
| 2 | 0.25 | Tolyltriazole | 90.5 | 50.79 |
| 3 | 0.25 | Tolyltriazole | 93.4 | 46.13 |
| 4 | 0.25 | 5 methyl benzimidazole | 94.8 | 35.16 |
| C-1 | 0.25 | — | −4.8 | 71.24 |
| C-2 | 0.25 | — | 4.8 | 68.02 |
| C-3 | 0.50 | — | 47.7 | 50.98 |
| C-4 | 0.25 | Tartaric Acid | 73.1 | 52.57 |
| C-5 | 0.25 | CCI-801 | 68.7 | 59.94 |
| C-6 | 0.25 | Belcor 590 | 69.7 | −38.37 |
| C-7 | 0.25 | Dibutylthiourea | 96.9 | 2.03 |
| C-8 | 0.25 | Cationic Surfactant | −174.4 | 7.41 |
| C-9 | 0.25 | Inhibitor R | 1.8 | 65.89 |
| C-10 | 0.25 | Alcodet SK | 49.9 | 75.26 |
| C-11 | 0.25 | Bricorr 288 | 18.1 | 51.12 |
| C-12 | 0.25 | Polyrad 1110 | 91.0 | 11.50 |
| C-13 | 0.25 | Citric Acid | 171.8 | 52.71 |
| C-14 | 0.25 | Gluconic Acid | 54.3 | 50.03 |
| C-15 | 0.25 | Polyrad 515 | 61.6 | 4.56 |
| C-16 | 0.25 | 2-Phenyl-2-Imidazoline | 62.9 | 47.97 |
| C-17 | 0.25 | Glucoheptonic Acid | 64.0 | 42.52 |
| C-18 | 0.25 | $NaNO_2$ | −31.4 | 20.13 |
| C-19 | 0.0 | Cationic Surfactant | −68.1 | 46.83 |
| C-20 | 0.25 | CMC | 59.6 | 52.16 |
| C-21 | 0.25 | Catechol | 67.6 | 77.80 |
| C-22 | 0.25 | Polyrad 515A | 77.6 | 13.51 |
| C-23 | 0.25 | Polyrad 1110[1] | 90.2 | 0.59 |
| C-24 | 0.25 | Pectin | 62.3 | 66.45 |
| C-25 | 0.25 | Glucoheptonic Acid | 57.9 | 50.49 |
| C-26 | 0.25 | Hexamethylene Tetraamine | 50.2 | 47.68 |

[1] May have been Polyrad 1110A

As demonstrated in Table 2, the inventive composition unexpectedly proved more effective at inhibiting base metal loss on AISI 533A with acceptable loss in metal oxide dissolution than any of the other compositions that were tested.

Examples 5–14 and Comparative Examples C-5A–C-14A

Further testing was performed using 4.35 wt % aqueous solutions of HEDP, for 72 hours, at pH 6.5, 110° F., containing Burco TME alone or Burco TME with Tolyltriazole.

Coupons were supplied by Metal Samples, Munsford, Ill. The HAZ coupons are manufactured as follows:

Two blocks of 533A material are welded on either side of a block of 1018 carbon steel using SMAW(shielded metal arc welding). Coupons are cut from the resulting block. Coupons can be taken from the 533A, 1018, or SMAW areas. Coupons taken from 533A or 1018 areas directly adjacent to the weld areas are the HAZ coupons due to the exposure of these coupons to the heat of welding. The HAZ coupons used in this testing were taken from the portion of the 533A material exposed to the heat of welding.

These results are presented in Table 3, as follows:

TABLE 3

| Metal in Coupon | Example No. | Metal Loss (microns) with 0.25 wt % Burco TME and 0.25 wt % Tolyltriazole | Example No. | Metal Loss (microns) with 0.25 wt % Burco TME |
|---|---|---|---|---|
| AISI 533A | 5 | 2.2[1] | C-5A | 27.33 |
| 1010 LCS | 6 | 0.53[1] | C-6A | 0.55[1] |
| 1015 LCS | 7 | 1.14 | C-7A | — |
| 1018 LCS | 8 | 1.11 | C-8A | — |
| 1035 LCS | 9 | 0.95 | C-9A | 5.37 |
| Alloy 409 | 10 | 0.16 | C-10A | 0.19 |
| Alloy 600 | 11 | 0.05 | C-11A | — |
| SA 515 Grade 70 | 12 | 0.8 | C-12A | — |
| SMAW - 7018 | 13 | 1.1 | C-13A | 5.39 |
| 533A - HAZ | 14 | 1.16[1] | C-14A | 4.31 |

[1]Average of multiple samples

As demonstrated in Table 3, the inventive composition proved more effective at inhibiting base metal loss than compositions containing Burco TME alone when applied to weld metals such as SMAW 7018, metals typically used for pressure vessel plating, such as AISI 533A, SMAW 7018, and metals that have been subjected to high heat in the welding process, such as 533A-HAZ. Still further, it is seen that AISI-1035 LCS, which is similar to AISI-1010 LCS, but contains higher levels of carbon, and is stronger and harder, has a significantly reduced metal loss when treated with a composition according to the present invention as compared to a composition containing Burco TME in the absence of Tolyltriazole.

Example 15

Following the procedure set forth in Examples 5–14, Tables 4 and 5 below show the results as metal loss rates that were seen for 533A and AISI-1010 low carbon steel with and without inhibitor.

TABLE 4

533 A Corrosion Rates

| | Mils per year (mpy) | Metal Loss (microns) |
|---|---|---|
| 4.35 wt % HEDP (no inhibitor) | 538 | 112 |
| 4.35 wt % HEDP and 0.25 wt % Burco TME | 137 | 28.6 |
| 4.35 wt % HEDP and 0.25 wt % Burco TME | 125 | 26.0 |
| 4.35 wt % HEDP, 0.25 wt % Burco TME, 0.25 wt % TTA | 10.5 | 2.20 |

TABLE 5

1010 Corrosion Rates

| | Mils per year (mpy) | Metal Loss (microns) |
|---|---|---|
| 4.35 wt % HEDP (no inhibitor) | — | — |
| 4.35 wt % HEDP and 0.25 wt % Burco TME | 3.67 | 0.55 |
| 4.35 wt % HEDP, 0.25 wt % Burco TME, 0.25 wt % TTA | 3.53 | 0.53 |

Example 16

Simple galvanic testing was performed using 4.35 wt % aqueous solutions of HEDP, for 72 hours, at pH 6.5, 110° F., containing Burco TME alone or Burco TME with Tolyltriazole. Test coupons of 1010 LCS or ASTM 533A were attached to a coupon of Inconel® Alloy 600 stainless steel so that the entire face of the coupons were electrically connected. Teflon hardware was used to limit the galvanic effects to the metallurgy to be tested. The coupled metal coupons each with a surface area of approximately 18.704 $cm^2$ were placed horizontally into the vessel such that they were fully immersed in the cleaning solution. The results are shown in Tables 6 and 7.

TABLE 6

533 A Galvanically Coupled to Alloy 600 Stainless Steel

| | Mils per year (mpy) | Metal Loss (microns) |
|---|---|---|
| 4.35 wt % HEDP and 0.25 wt % Burco TME | 46.14 | 9.63 |
| 4.35 wt % HEDP, 0.25 wt % Burco TME, 0.25 wt % TTA | 23.48 | 4.90 |

TABLE 7

LCS 1010 Galvanically Coupled to Alloy 600 Stainless Steel

| | Mils per year (mpy) | Metal Loss (microns) |
|---|---|---|
| 4.35 wt % HEDP and 0.25 wt % Burco TME | 19.07 | 3.98 |
| 4.35 wt % HEDP, 0.25 wt % Burco TME, 0.25 wt % TTA | 13.85 | 2.89 |

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what we claim is:

1. The method for cleaning iron oxide containing scale from a surface of at least one of high strength steels, steels used for pressure vessel plating, welded metals, steels galvanically coupled to stainless steels, and steels containing heat affected zones (HAZ) resulting from a welding process, comprising contacting the surface with a composition comprising 1-hydroxy-ethylidene-1,1-diphosphonic acid and at least one of ethoxylated mercaptan and oxidized ethoxylated mercaptan, and at least one of benzotriazole and benzimidazole compound having the following structure:

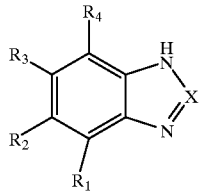

wherein X is C or N, each of $R_1$, $R_2$, $R_3$ and $R_4$ is hydrogen, halogen, or a hydrocarbyl group.

2. The process according to claim 1, wherein each of $R_1$, $R_2$, $R_3$ and $R_4$ comprises hydrogen or an alkyl or substituted alkyl.

3. The process according to claim 2, wherein the alkyl or substituted alkyl contains $C_1$ to $C_8$.

4. The process according to claim 3, wherein the alkyl or substituted alkyl contains $C_1$ to $C_4$.

5. The process according to claim 4, wherein X is C.

6. The process according to claim 4, wherein X is N.

7. The process according to claim 4, wherein the alkyl or substituted alkyl is branched.

8. The process according to claim 4, wherein the alkyl or substituted alkyl is straight chained.

9. The process according to claim 1, wherein three of the $R_1$, $R_2$, $R_3$ and $R_4$ groups comprise hydrogen, and the fourth $R_1$, $R_2$, $R_3$ and $R_4$ group comprises an alkyl or substituted alkyl group.

10. The process according to claim 9, wherein the alkyl or substituted alkyl contains $C_1$ to $C_4$.

11. The process according to claim 1, wherein X is N.

12. The process according to claim 11, wherein the benzotriazole compound comprises butyl-benzotriazole.

13. The process according to claim 11, wherein the benzotriazole compound comprises tolyltriazole.

14. The method according to claim 11, wherein the surface comprises a steel having a carbon content higher than 0.15 wt %.

15. The method according to claim 14, wherein the surface comprises a steel having a carbon content higher than 0.2 wt %.

16. The method according to claim 15, wherein the surface comprises a steel having a carbon content higher than 0.3 wt %.

17. The method according to claim 11, wherein the surface comprises a steel having a Mn content of higher than 0.9 wt %.

18. The method according to claim 11, wherein the surface comprises a surface of a pressure vessel steel.

19. The method according to claim 11, wherein the surface comprises a surface of steels containing heat affected zones (HAZ).

20. The process according to claim 1, wherein X is C.

21. The method according to claim 20, wherein the surface comprises a steel having a carbon content higher than 0.15 wt %.

22. The method according to claim 21, wherein the surface comprises a steel having a carbon content higher than 0.2 wt %.

23. The method according to claim 22 wherein the surface comprises a steel having a carbon content higher than 0.3 wt %.

24. The process according to claim 20, wherein the benzimidazole compound comprises 5-methyl benzimidazole.

25. The method according to claim 20, wherein the surface comprises a steel having a Mn content of higher than 0.9 wt %.

26. The method according to claim 20, wherein the surface comprises a surface of a pressure vessel steel.

27. The method according to claim 20, wherein the surface comprises a surface of steels containing heat affected zones (HAZ).

28. The process according to claim 1, wherein said ethoxylated mercaptan has the formula:

$$H—(—O—CH_2—CH_2—)_n—S—R_1$$

wherein $R_1$ is a hydrocarbyl group, n is 1 to 100, and said oxidized ethoxylated mercaptan comprises oxidized derivatives thereof.

29. The method according to claim 1, wherein the surface comprises a steel containing up to 0.25 wt % C, 1.15–1.50 wt % Mn, 0.035 wt % P, 0.04 wt % S, 0.21 wt % Si, 0.45–0.60 wt % Mo, and balance Fe.

30. The method according to claim 29, wherein the steel further contains 0.40–0.60 wt % Ni.

31. The method according to claim 1, wherein the surface comprises a steel containing 0.31–0.38 wt % C, 0.60–0.90 wt % Mn, up to 0.04 wt % P, up to 0.05 wt % S, balance Fe.

32. The method according to claim 1, wherein the surface comprises a steel containing up to 0.35 wt % C, up to 0.90 wt % Mn, 0.35 wt % P, up to 0.04 wt % S, 0.15–0.30 wt % Si, balance Fe.

33. The method according to claim 1, wherein the surface comprises a steel containing at least one of molybdenum, chromium and nickel.

34. The method according to claim 33, where the surface comprises a steel containing nickel.

35. The method according to claim 1, wherein the surface comprises a mild steel that is galvanically coupled to stainless steel.

36. The method according to claim 1, wherein the surface comprises a high strength or pressure vessel plating steel that is galvanically coupled to stainless steel.

* * * * *